US012504183B2

(12) United States Patent
Docksteader et al.

(10) Patent No.: US 12,504,183 B2
(45) Date of Patent: Dec. 23, 2025

(54) ACTIVE HVAC DOOR AND METHODS

(71) Applicant: Masonite Corporation, Tampa, FL (US)

(72) Inventors: Benjamin W. Docksteader, Custer, WA (US); Joel Sellinger, Blaine, WA (US)

(73) Assignee: Masonite Corporation, Tampa, FL (US)

( * ) Notice: Subject to any disclaimer, the term of this patent is extended or adjusted under 35 U.S.C. 154(b) by 412 days.

(21) Appl. No.: 18/326,831

(22) Filed: May 31, 2023

(65) Prior Publication Data

US 2023/0383967 A1 Nov. 30, 2023

Related U.S. Application Data

(60) Provisional application No. 63/347,271, filed on May 31, 2022.

(51) Int. Cl.

| | |
|---|---|
| ***F24F 7/013*** | (2006.01) |
| ***F24F 11/00*** | (2018.01) |
| ***F24F 13/14*** | (2006.01) |
| ***F24F 13/18*** | (2006.01) |

(52) U.S. Cl.

CPC ..... *F24F 7/013* (2013.01); *F24F 11/0001* (2013.01); *F24F 13/1426* (2013.01); *F24F 13/18* (2013.01); *F24F 2013/1433* (2013.01)

(58) Field of Classification Search

CPC ..... F24F 7/013; F24F 11/0001; F24F 13/18

See application file for complete search history.

(56) References Cited

U.S. PATENT DOCUMENTS

| | | | | |
|---|---|---|---|---|
| 2,084,807 | A | 6/1937 | Hueglin | |
| 4,164,172 | A | 8/1979 | Anderten et al. | |
| 4,644,687 | A | 2/1987 | Liou | |
| 4,770,087 | A | 9/1988 | Danley et al. | |
| 5,255,486 | A | 10/1993 | Wang | |
| 5,392,577 | A | 2/1995 | D'Onofrio, Jr. et al. | |
| 5,976,009 | A | 11/1999 | Achen | |
| 6,386,969 | B1 | 5/2002 | O'Brien | |
| 6,524,181 | B2 | 2/2003 | Wasson | |
| 7,160,185 | B1 * | 1/2007 | Gemmer | F24F 7/013 454/195 |
| 7,824,200 | B2 | 11/2010 | Bryla et al. | |

(Continued)

FOREIGN PATENT DOCUMENTS

| | | | | |
|---|---|---|---|---|
| AU | 2020101466 | A4 | 8/2020 | |
| CH | 704075 | A1 * | 5/2012 | E06B 7/09 |

(Continued)

*Primary Examiner* — Allen R. B. Schult

(74) *Attorney, Agent, or Firm* — IceMiller LLP

(57) ABSTRACT

An active HVAC door and a method of opening or closing a door having a door handle, at least one hinge configured to pivotally couple the door to a frame, a first fan assembly provided through the door on an upper portion and on the handle side thereof and a second fan assembly provided through the door on a lower portion and on the handle side thereof, wherein the first and second fan assemblies comprise at least one electrically reversible fan driven by an electric motor and movable louvers by using an actuator to move the louvers between open and closed positions based on a signal from an electronic control module.

20 Claims, 16 Drawing Sheets

(56) References Cited

U.S. PATENT DOCUMENTS

| | | | |
|---|---|---|---|
| 8,156,671 | B2 | 4/2012 | Presley et al. |
| 8,169,169 | B2 | 5/2012 | Hass et al. |
| 8,337,039 | B1 | 12/2012 | Larkin |
| 8,354,914 | B2 | 1/2013 | Buckingham et al. |
| 8,662,971 | B2 | 3/2014 | Warner |
| 8,772,970 | B2 | 7/2014 | Lambrou |
| 9,163,845 | B1 * | 10/2015 | Carlozzi ..... F04D 29/582 |
| 9,290,966 | B2 | 3/2016 | Hanchett, Jr. |
| 9,652,917 | B2 | 5/2017 | Johnson et al. |
| 9,704,320 | B2 | 7/2017 | Johnson et al. |
| 9,922,513 | B1 | 3/2018 | Hall et al. |
| 9,970,669 | B2 | 5/2018 | Chang et al. |
| 10,012,408 | B1 * | 7/2018 | Crittenden ..... E06B 7/04 |
| 10,037,636 | B2 | 7/2018 | Ho et al. |
| 10,043,332 | B2 | 8/2018 | Scalisi et al. |
| 10,361,880 | B1 | 7/2019 | Marcinkowski et al. |
| 10,453,280 | B2 | 10/2019 | Kontturi |
| 10,664,688 | B2 | 5/2020 | Goulden et al. |
| 10,691,953 | B2 | 6/2020 | Johnson et al. |
| 10,733,823 | B2 | 8/2020 | Scalisi |
| 10,755,509 | B2 | 8/2020 | Saeedi et al. |
| 10,803,685 | B2 | 10/2020 | Marcinkowski et al. |
| 10,818,118 | B2 | 10/2020 | Sivalingam et al. |
| 10,938,250 | B2 | 3/2021 | Ahmed et al. |
| 10,950,076 | B1 | 3/2021 | Hall et al. |
| 10,964,138 | B2 | 3/2021 | Geerlings et al. |
| 10,997,547 | B2 | 5/2021 | Hall et al. |
| 10,999,092 | B2 | 5/2021 | Marcinkowski et al. |
| 11,174,666 | B2 | 11/2021 | Demele et al. |
| 11,244,523 | B1 | 2/2022 | Brady et al. |
| 11,248,410 | B2 | 2/2022 | Dreyer et al. |
| 11,290,298 | B2 | 3/2022 | Marcinkowski et al. |
| 11,339,604 | B2 | 5/2022 | Dreyer |
| 11,346,141 | B2 | 5/2022 | Gregoriou |
| 11,346,150 | B1 | 5/2022 | Johnston |
| 11,352,812 | B2 | 6/2022 | Johnson |
| 11,373,471 | B2 | 6/2022 | Anderson et al. |
| D957,688 | S | 7/2022 | Kim et al. |
| 11,388,373 | B2 | 7/2022 | Scalisi |
| 11,403,899 | B2 | 8/2022 | Zhang |
| 11,403,902 | B2 | 8/2022 | Ho et al. |
| 11,417,200 | B2 | 8/2022 | Hass et al. |
| 11,441,332 | B2 | 9/2022 | Johnson et al. |
| 11,532,192 | B2 | 12/2022 | Hass et al. |
| 11,536,078 | B2 | 12/2022 | Dreyer |
| 11,539,794 | B1 | 12/2022 | Weber et al. |
| 11,543,801 | B2 | 1/2023 | Hall et al. |
| 11,655,669 | B2 | 5/2023 | Hutton et al. |
| 11,694,287 | B2 | 7/2023 | Marcinkowski et al. |
| 11,729,014 | B2 | 8/2023 | Marcinkowski et al. |
| 11,767,710 | B1 | 9/2023 | Johnston |
| 2014/0020295 | A1 | 1/2014 | Bonahoom et al. |
| 2014/0267739 | A1 | 9/2014 | Ibsies |
| 2016/0163139 | A1 | 6/2016 | Kankkunen et al. |
| 2016/0322847 | A1 | 11/2016 | Geiszler |
| 2017/0040827 | A1 | 2/2017 | Weber |
| 2017/0358952 | A1 | 12/2017 | Butler et al. |
| 2019/0271186 | A1 | 9/2019 | Chen et al. |
| 2019/0333302 | A1 | 10/2019 | Kagnew et al. |
| 2020/0014552 | A1 | 1/2020 | Tan et al. |
| 2020/0082240 | A1 | 3/2020 | Heitmar |
| 2020/0349786 | A1 | 11/2020 | Ho et al. |
| 2020/0378172 | A1 | 12/2020 | Lerpard |
| 2021/0207419 | A1 | 7/2021 | Sorice et al. |
| 2021/0207420 | A1 | 7/2021 | Sorice et al. |
| 2021/0207421 | A1 | 7/2021 | Sorice et al. |
| 2021/0209878 | A1 | 7/2021 | Kim et al. |
| 2022/0155005 | A1 | 5/2022 | Lee et al. |
| 2022/0186543 | A1 | 6/2022 | Soderqvist |
| 2022/0263297 | A1 | 8/2022 | Bodurka et al. |
| 2022/0351722 | A1 | 11/2022 | Mandry et al. |
| 2022/0392287 | A1 | 12/2022 | Shen |
| 2023/0062621 | A1 | 3/2023 | Cheung |
| 2023/0184022 | A1 | 6/2023 | Eliasson et al. |

FOREIGN PATENT DOCUMENTS

| | | | |
|---|---|---|---|
| CN | 200968110 | Y | 10/2007 |
| CN | 103606213 | A | 2/2014 |
| CN | 104105248 | A | 10/2014 |
| CN | 203925102 | U | 11/2014 |
| CN | 205117039 | U | 3/2016 |
| CN | 106761274 | A | 5/2017 |
| CN | 106836990 | A | 6/2017 |
| CN | 206309153 | U | 7/2017 |
| CN | 206329255 | U | 7/2017 |
| CN | 107191110 | A | 9/2017 |
| CN | 107448128 | A | 12/2017 |
| CN | 107575137 | A | 1/2018 |
| CN | 107610390 | A | 1/2018 |
| CN | 107643706 | A | 1/2018 |
| CN | 206903524 | U | 1/2018 |
| CN | 107705511 | A | 2/2018 |
| CN | 107730687 | A | 2/2018 |
| CN | 107747457 | A | 3/2018 |
| CN | 107795255 | A | 3/2018 |
| CN | 107829659 | A | 3/2018 |
| CN | 108118987 | A | 6/2018 |
| CN | 207458156 | U | 6/2018 |
| CN | 108389290 | A | 8/2018 |
| CN | 108399674 | A | 8/2018 |
| CN | 108412359 | A | 8/2018 |
| CN | 108442852 | A | 8/2018 |
| CN | 108661486 | A | 10/2018 |
| CN | 108756617 | A | 11/2018 |
| CN | 108868508 | A | 11/2018 |
| CN | 108915498 | A | 11/2018 |
| CN | 108924015 | A | 11/2018 |
| CN | 108952449 | A | 12/2018 |
| CN | 109098543 | A | 12/2018 |
| CN | 109138774 | A | 1/2019 |
| CN | 109191617 | A | 1/2019 |
| CN | 109191739 | A | 1/2019 |
| CN | 109236134 | A | 1/2019 |
| CN | 109236135 | A | 1/2019 |
| CN | 109267837 | A | 1/2019 |
| CN | 109472902 | A | 3/2019 |
| CN | 208777869 | U | 4/2019 |
| CN | 110009782 | A | 7/2019 |
| CN | 110264682 | A | 9/2019 |
| CN | 209429913 | U | 9/2019 |
| CN | 110409954 | A | 11/2019 |
| CN | 110505182 | A | 11/2019 |
| CN | 110531631 | A | 12/2019 |
| CN | 209990389 | U | 1/2020 |
| CN | 110778265 | A | 2/2020 |
| CN | 111173404 | A | 5/2020 |
| CN | 111270959 | A | 6/2020 |
| CN | 111343432 | A | 6/2020 |
| CN | 111441680 | A | 7/2020 |
| CN | 211038390 | U | 7/2020 |
| CN | 211124167 | U | 7/2020 |
| CN | 111505947 | A | 8/2020 |
| CN | 111540093 | A | 8/2020 |
| CN | 111653025 | A | 9/2020 |
| CN | 111764747 | A | 10/2020 |
| CN | 211851423 | U | 11/2020 |
| CN | 112096221 | A | 12/2020 |
| CN | 112211496 | A | 1/2021 |
| CN | 112267796 | A | 1/2021 |
| CN | 112330869 | A | 2/2021 |
| CN | 112491668 | A | 3/2021 |
| CN | 112539020 | A | 3/2021 |
| CN | 213205374 | U | 5/2021 |
| CN | 112901047 | A | 6/2021 |
| CN | 113048374 | A | 6/2021 |
| CN | 113129476 | A | 7/2021 |
| CN | 113338772 | A | 9/2021 |
| CN | 113345130 | A | 9/2021 |
| CN | 113545639 | A | 10/2021 |
| CN | 113645446 | A | 11/2021 |
| CN | 113674454 | A | 11/2021 |
| CN | 113706744 | A | 11/2021 |
| CN | 214835862 | U | 11/2021 |

(56) References Cited

FOREIGN PATENT DOCUMENTS

| | | | |
|---|---|---|---|
| CN | 214886488 | U | 11/2021 |
| CN | 214943492 | U | 11/2021 |
| CN | 215169563 | U | 12/2021 |
| CN | 113947834 | A | 1/2022 |
| CN | 217240775 | U | 8/2022 |
| CN | 217307315 | U | 8/2022 |
| CN | 115095246 | A | 9/2022 |
| CN | 115164381 | A | 10/2022 |
| CN | 115235096 | A | 10/2022 |
| CN | 115294675 | A | 11/2022 |
| CN | 115324428 | A | 11/2022 |
| CN | 115341821 | A | 11/2022 |
| CN | 115393988 | A | 11/2022 |
| CN | 218454661 | U | 2/2023 |
| CN | 115798084 | A | 3/2023 |
| CN | 116251221 | A | 6/2023 |
| CN | 219197192 | U | 6/2023 |
| CN | 219246122 | U | 6/2023 |
| CN | 116498183 | A | 7/2023 |
| CN | 116760602 | A | 9/2023 |
| CN | 117238059 | A | 12/2023 |
| DE | 202022101334 | U1 | 5/2022 |
| EP | 3118405 | A1 | 1/2017 |
| EP | 3537398 | A1 | 9/2019 |
| EP | 3845729 | A1 | 7/2021 |
| FR | 3132160 | A3 | 7/2023 |
| IN | 201921017138 | A | 5/2019 |
| IN | 201911049967 | A | 12/2019 |
| IN | 201911048995 | A | 5/2021 |
| IN | 202111053824 | A | 12/2021 |
| IN | 202241020116 | A | 4/2022 |
| IN | 202241026843 | A | 5/2022 |
| IN | 411059 | B | 11/2022 |
| IN | 202111013824 | A | 12/2022 |
| IN | 430120 | B | 4/2023 |
| IN | 202341019331 | A | 4/2023 |
| JP | 6680821 | B2 | 3/2020 |
| JP | 2020042440 | A | 3/2020 |
| JP | 6777955 | B2 | 10/2020 |
| KR | 20160025226 | A | 3/2016 |
| KR | 20160050965 | A | 5/2016 |
| KR | 20160123639 | A | 10/2016 |
| KR | 20160124481 | A | 10/2016 |
| KR | 101800514 | B1 | 12/2017 |
| KR | 20180076537 | A | 7/2018 |
| KR | 20180131716 | A | 12/2018 |
| KR | 101988851 | B1 | 6/2019 |
| KR | 20190098719 | A | 8/2019 |
| KR | 20190098720 | A | 8/2019 |
| KR | 102024754 | B1 | 9/2019 |
| KR | 102079532 | B1 | 2/2020 |
| KR | 102150642 | B1 | 9/2020 |
| KR | 20200143302 | A | 12/2020 |
| KR | 20210004253 | A | 1/2021 |
| KR | 20210016726 | A | 2/2021 |
| KR | 20210019211 | A | 2/2021 |
| KR | 20210019216 | A | 2/2021 |
| KR | 20210019218 | A | 2/2021 |
| KR | 20210019241 | A | 2/2021 |
| KR | 20210045195 | A | 4/2021 |
| KR | 20210072510 | A | 6/2021 |
| KR | 20210078199 | A | 6/2021 |
| KR | 102303254 | B1 | 9/2021 |
| KR | 102329035 | B1 | 11/2021 |
| KR | 102341883 | B1 | 12/2021 |
| KR | 20210153308 | A | 12/2021 |
| KR | 20220031428 | A | 3/2022 |
| KR | 102421708 | B1 | 7/2022 |
| KR | 20220113136 | A | 8/2022 |
| KR | 20220119878 | A | 8/2022 |
| KR | 102472384 | B1 | 12/2022 |
| KR | 102534826 | B1 | 5/2023 |
| TW | M627626 | U | 6/2022 |
| WO | 2013163124 | A1 | 10/2013 |
| WO | 2016032464 | A1 | 3/2016 |
| WO | 2016175910 | A1 | 11/2016 |
| WO | 2017024088 | A1 | 2/2017 |
| WO | 2018184450 | A1 | 10/2018 |
| WO | 2018184452 | A1 | 10/2018 |
| WO | 2018184453 | A1 | 10/2018 |
| WO | 2018184454 | A1 | 10/2018 |
| WO | 2019068021 | A1 | 4/2019 |
| WO | 2019162435 | A1 | 8/2019 |
| WO | 2022004989 | A1 | 1/2022 |
| WO | 2022010071 | A1 | 1/2022 |
| WO | 2022010072 | A1 | 1/2022 |
| WO | 2022010073 | A1 | 1/2022 |
| WO | 2022010074 | A1 | 1/2022 |
| WO | 2022020893 | A1 | 2/2022 |
| WO | 2022145966 | A1 | 7/2022 |
| WO | 2022263147 | A1 | 12/2022 |
| WO | 2023180427 | A1 | 9/2023 |

* cited by examiner

ACTIVE HVAC DOOR AND METHODS

CROSS REFERENCE TO RELATED APPLICATIONS

This application claims the benefit of U.S. Provisional Patent Application Ser. No. 63/347,271 filed May 31, 2022, the disclosure of which is incorporated herein by reference in its entirety.

FIELD OF THE INVENTION

The present invention is related generally to power door mechanisms, and more specifically to a door including fan assemblies employed to open and/or close the door, as well as a method of operating the door.

BACKGROUND OF THE INVENTION

Conventionally, exterior and interior doors are pivotally mounted to a doorjamb by at least a pair of hinges and handle hardware. A powered door mechanism may be provided to apply a mechanical force to a door to open or close the door.

The force required to move the door mechanically varies widely, and most products apply a force at the hinge side of doors requiring high forces to change door position. Additionally, controlling door position beyond 100 degrees open angle creates complexity in any of the mechanical designs. There is also loss of leverage in some designs when the door position is beyond 100 degrees. Home construction variations show ranges from 90 degrees to 180 degrees as maximum open angle. Avoiding mechanical connection points allows the mechanism to work regardless of the maximum angle. Powered door opening mechanisms may use a drive wheel on the floor to apply force to the knob side of the door.

Exterior doors are generally solid and do not allow air to pass through them. Bringing fresh outside air into a structure prior to the advent of the present exterior door was either by opening a window or an exterior door. That is a most logical manner in which outdoor air is introduced into a structure, and is a very easy solution. The problem with such a solution is simply a matter of opening and closing a window or windows and then shutting them again. The simple solution also becomes acute when the structure, typically a home, is left without anyone being present. An open window is an invitation to burglars. Moreover, open windows and a vacant home in a rain storm invite water damage from simple wetting to extensive damage. An open door is even more impractical, for obvious reasons, including all of the above negative comments for open windows.

While known solutions to automatically open and/or close doors have proven to be acceptable for various applications, such devices are nevertheless susceptible to improvements that may enhance their performance and cost. With this in mind, a need exists to develop a mechanism for automatically opening and/or closing a door that advances the art.

SUMMARY

The present disclosure provides exemplary embodiments that overcomes the deficiencies of the prior art by providing an active HVAC door and a method of opening or closing a door. In exemplary aspects, the disclosure describes an exemplary door having a door handle, at least one hinge configured to pivotally couple the door to a frame, a first fan assembly provided through the door on an upper portion and on the handle side thereof and a second fan assembly provided through the door on a lower portion and on the handle side thereof, wherein the first and second fan assemblies comprise at least one electrically reversible fan driven by an electric motor and movable louvers by using an actuator to move the louvers between open and closed positions based on a signal from an electronic control module.

Other aspects of the invention, including devices, systems, methods and the like which constitute part of the invention, will become more apparent upon reading the following detailed description of various exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF EXEMPLARY EMBODIMENTS

Figure 1:
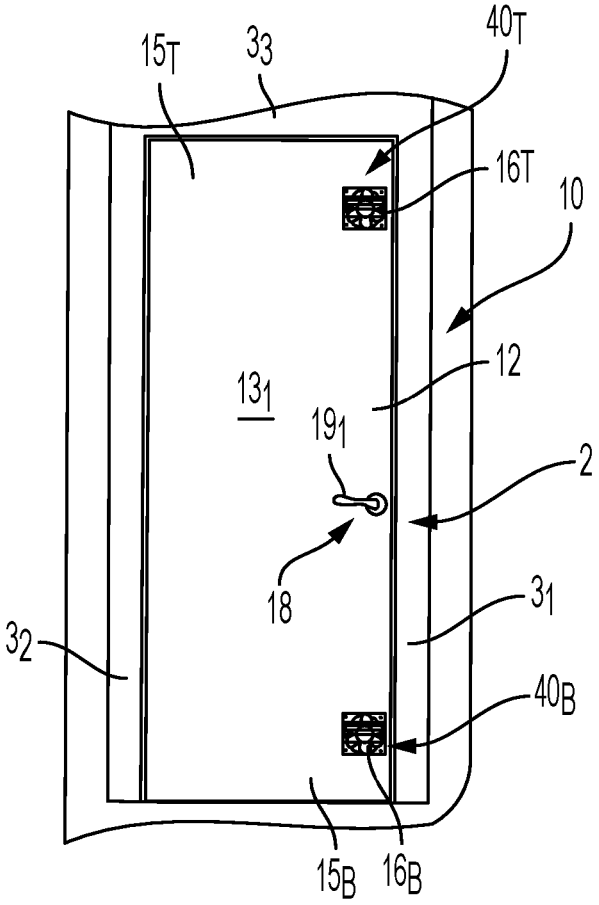
FIG. 1 is an exterior view of an automated and ventilated door according to a first exemplary embodiment of the present invention mounted to a door frame.

Reference will now be made in detail to the exemplary embodiments and exemplary methods as illustrated in the accompanying drawings, in which like reference characters designate like or corresponding parts throughout the drawings. It should be noted, however, that the invention in its broader aspects is not necessarily limited to the specific details, representative materials and methods, and illustrative examples shown and described in connection with the exemplary embodiments and exemplary methods.

This description of exemplary embodiments is intended to be read in connection with the accompanying drawings, which are to be considered part of the entire written description. In the description, relative terms such as "horizontal," "vertical," "front," "rear," "upper", "lower", "top" and "bottom" as well as derivatives thereof (e.g., "horizontally," "vertically," "downwardly," "upwardly," etc.) should be construed to refer to the orientation as then described or as shown in the drawing figure under discussion and to the orientation relative to a vehicle body. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. The term "integral" (or "unitary") relates to a part made as a single part, or a part made of separate components fixedly (i.e., non-moveably) connected together. Additionally, the word "a" and "an" as used in the claims means "at least one" and the word "two" as used in the claims means "at least two".

FIGS. 1-4 depict an automated and ventilated door 10 according to a first exemplary embodiment of the present invention. The automated door 10 is a hinged, preferably interior, residential door. It should be understood that the door 10 may be an exterior or interior door provided for a residential or commercial building, such as a home, apartment, garage, condominium, hotel, office building, or the like. The door 10 may be made of any appropriate material, such as wood, metal, wood composite material, fiberglass reinforced polymer composite or the like. The door 10 is pivotally mounted to a substantially rectangular frame assembly 2 by at least one hinge 4, such as a "butt hinge" that includes two leaves.

The frame assembly 2 includes first and second parallel, spaced apart vertically extending strike and hinge jamb members $\mathbf{3}_1$ and $\mathbf{3}_2$, respectively, and a horizontally extending upper jamb member or header $\mathbf{3}_3$ that connects upper ends of the first and second jamb members $\mathbf{3}_1$, $\mathbf{3}_2$. Those skilled in the art recognize that lower ends of the jamb members $\mathbf{3}_1$, $\mathbf{3}_2$ may be interconnected through a threshold.

Figure 2:
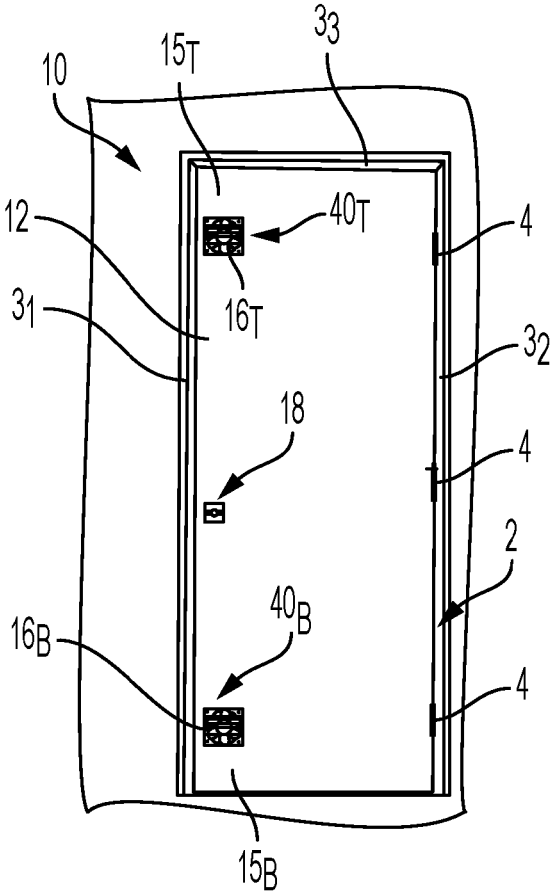
FIG. 2 is an interior view of the automated and ventilated door according to the first exemplary embodiment mounted to the door frame.

The at least one hinge 4 pivotally attaches the door 10 to the second jamb member $\mathbf{3}_2$. Typically, at least two hinges 4 are provided to secure the door 10 to the second jamb member $\mathbf{3}_2$. Preferably, as best shown in FIG. 2, three hinges 4 are used to secure the door 10 to the frame assembly 2.

Figure 3:
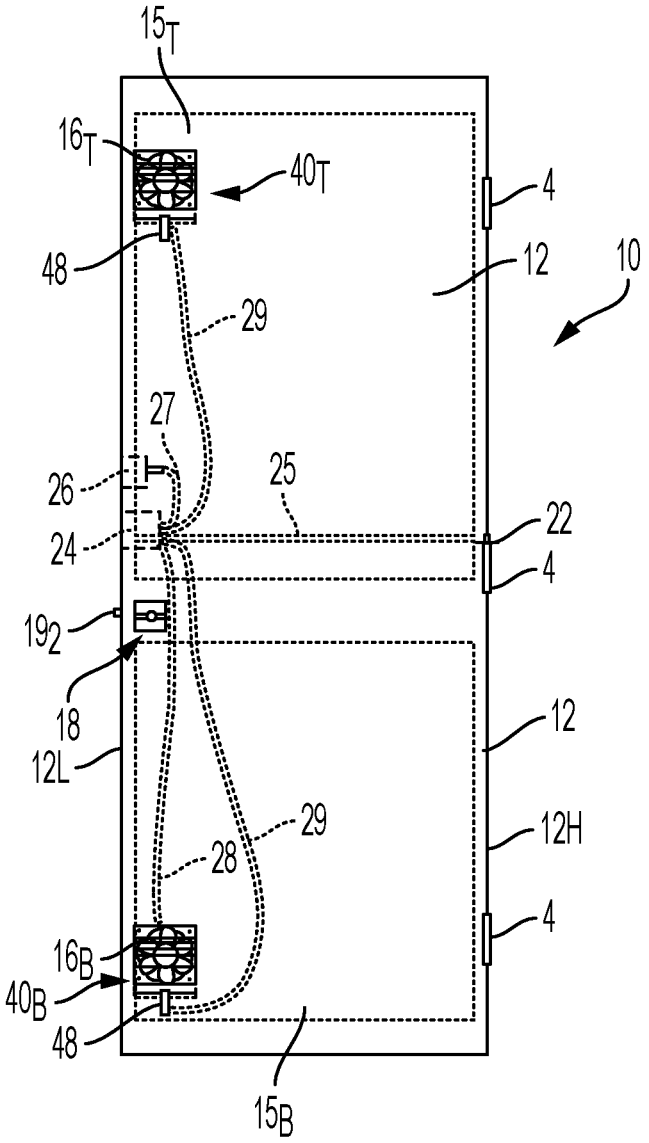
FIG. 3 shows the door of FIG. 1 with portions exposed.

The door 10 includes a hollow door slab 12 having a rectangular inner door frame 14, an exterior door skin (or facing) $\mathbf{13}_1$ (defining an exterior (or outward facing) side of the door 10 facing a common area $\mathbf{6}_1$ of a house or apartment) and an interior door skin (or facing) $\mathbf{13}_2$ (defining an interior (or inward facing) side of the door 10 facing a room 62 of the house or apartment separated by the door 10). The door skins $\mathbf{13}_1$ and $\mathbf{13}_2$ are secured, e.g., typically adhesively, to opposite sides of the inner door frame 14 so that the inner door frame 14 is sandwiched between the exterior and interior door skins $\mathbf{13}_1$ and $\mathbf{13}_2$. Typically, the door skins $\mathbf{13}_1$ and $\mathbf{13}_2$ are made of a polymer-based composite, such as sheet molding compound ("SMC") or medium-density fiberboard (MDF), other wood composite materials, fiber-reinforced polymer, such as fiberglass, hardboard, fiberboard, steel, and other thermoplastic materials. The door slab 12 has a hinge side 12H mounted to the frame assembly 2 by the hinges 4, and a horizontally opposite latch side 12L. Moreover, the door 10 has a top (or upper) end 15T and a bottom (or lower) end 15B, as best shown in FIGS. 1-3.

The door 10 further comprises a powered door latch 18 mounted to the door slab 12, an angle finder (or detector) 22, an electronic control module 24 operatively (such as electrically) connected to (or is in electronic communication with) the angle finder 22 through a power cable (or wires) 25 or, alternatively, by wireless communication, and a battery (or battery pack) 26 operatively (such as electrically) connected to the electronic control module 24 through a power cable (or wires) 27.

The powered door latch 18 has a door handle (or lever) $\mathbf{19}_1$ and a latch bolt $\mathbf{19}_2$, which may extend laterally from the latch side 12L of the door slab 12 to engage a latch bore in the strike and hinge jamb member $\mathbf{3}_1$ and thereby prevent the door 10 from opening. The latch bolt $\mathbf{19}_2$ may be spring-loaded outwardly and have a leading beveled end face, and is well known in the art. The leading beveled end face of the latch bolt $\mathbf{19}_2$ is angled to allow the door hardware (i.e., the door latch 18 with the latch bolt $\mathbf{19}_2$) to easily close. When the latch bolt $\mathbf{19}_2$ comes against a latch plate as the door 10 closes, the entire latch bolt $\mathbf{19}_2$ is cammed inwardly to a retracted condition with respect to the door latch 18. The door handle $\mathbf{19}_1$ of the door latch 18 is typically used for manually retracting the latch bolt $\mathbf{19}_2$ to free it from the latch plate so as to enable the door 10 to be opened.

According to the first exemplary embodiment, the battery 26 is a rechargeable battery (or one or more battery packs) that is charged by low-voltage DC electrical power. Alternatively, the powered door latch 18 may be replaced with various other latch mechanisms. Also, the battery pack 26 may be replaced with AC power via the hinge side 12H of the door slab 12.

Figure 6:
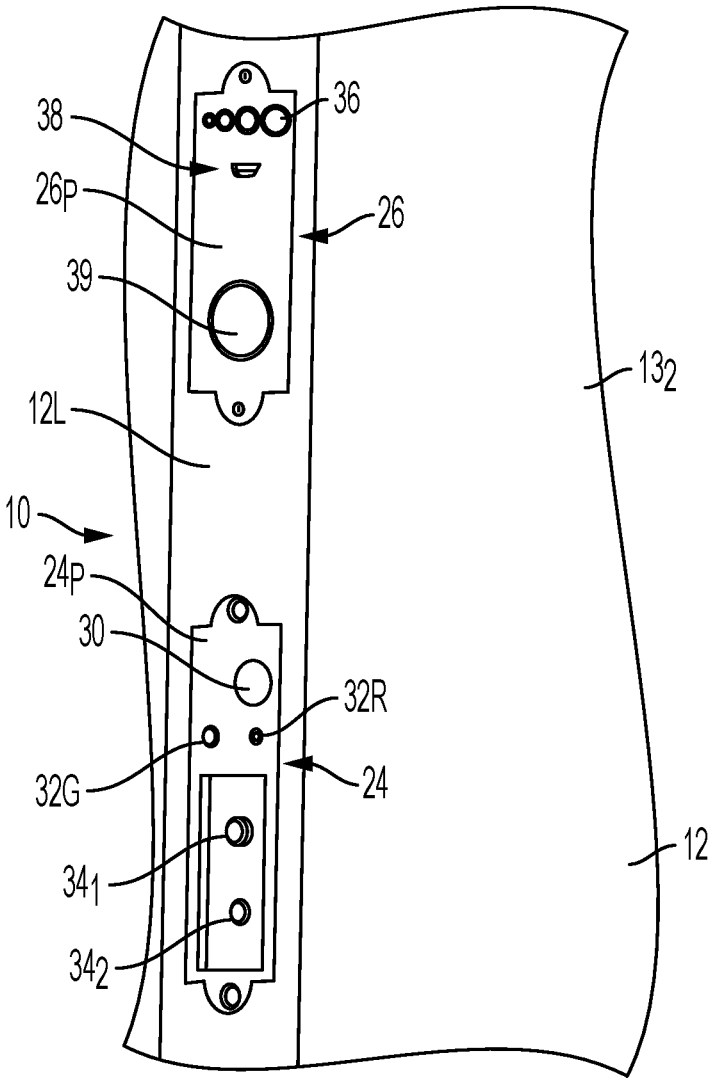
FIG. 6 is an enlarged partial interior view of the door according to the first exemplary embodiment with the exposed latch side thereof.

The control module 24, as best shown in FIG. 3, includes a proximity switch 30, status lights, such as green and red LED status lights 32G and 32R, respectively, and user interface buttons (UI buttons) $\mathbf{34}_1$ and $\mathbf{34}_2$ accessible on a controller cover plate 24*p*, as best shown in FIG. 6. The battery pack 26 may include hardware and/or software to monitor the status of the rechargeable battery pack 26. The battery pack 26 may also include a charging status indicator (e.g., one or more LED lights or display) 36 displaying the charging status of the rechargeable battery pack 26 and visible on a battery cover plate 26*p*, as best shown in FIG. 6. The battery pack 26 may further include a USB charger 38 for recharging the battery pack 26, and a master power/control button 39, both accessible on the battery cover plate 26*p*, as best shown in FIG. 6.

Figure 4:
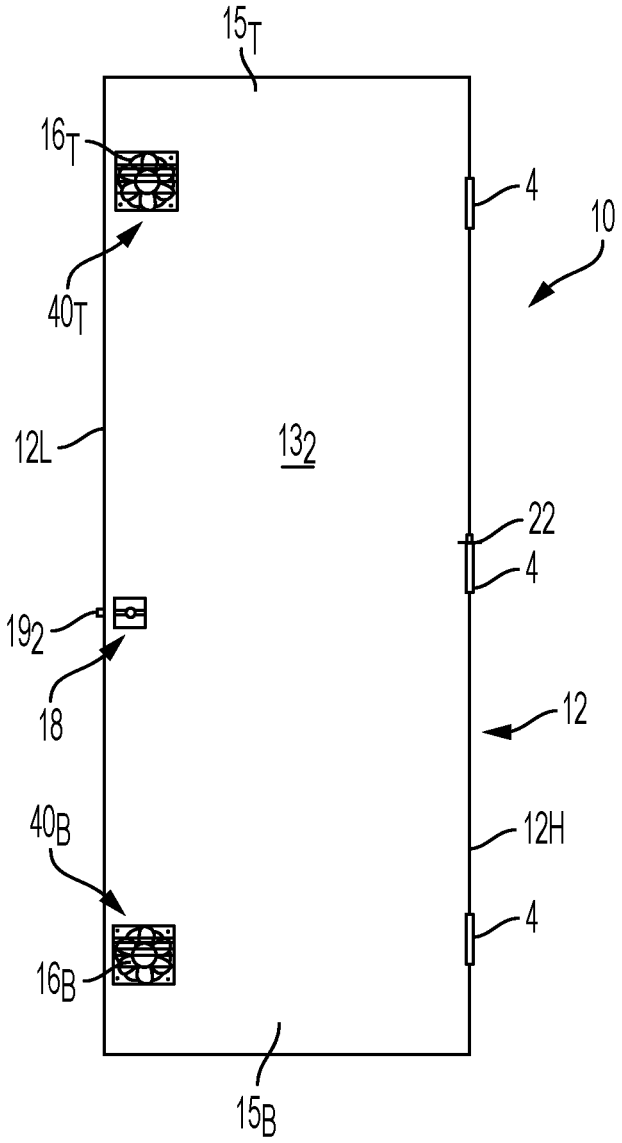
FIG. 4 is an interior view of the automated and ventilated door according to the first exemplary embodiment.
Figure 5:
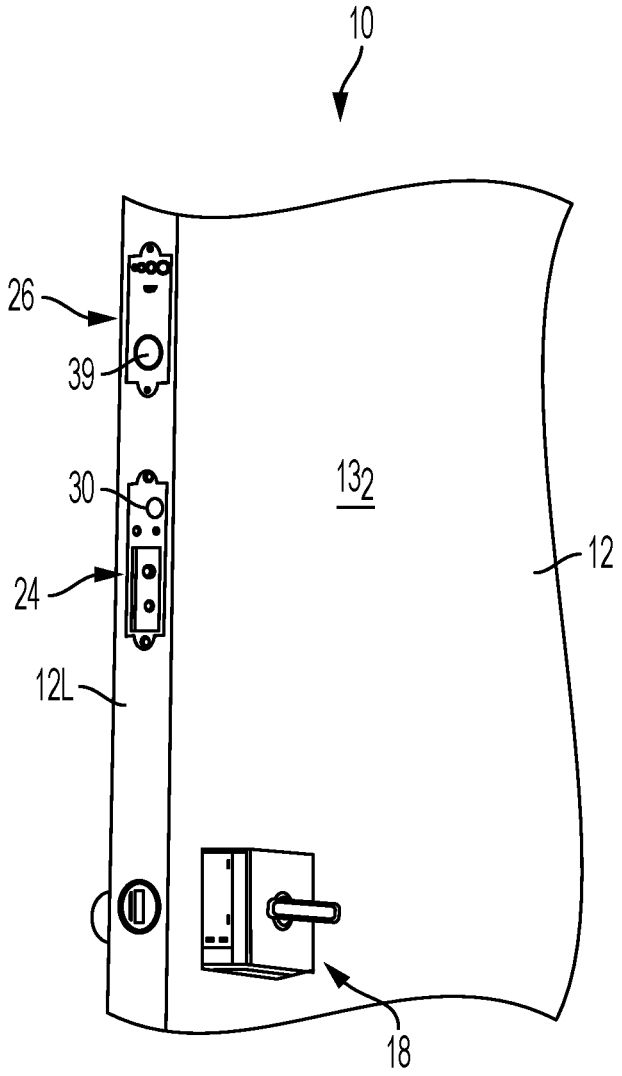
FIG. 5 is a partial interior view of the door according to the first exemplary embodiment with an exposed latch side thereof.
Figure 7A:
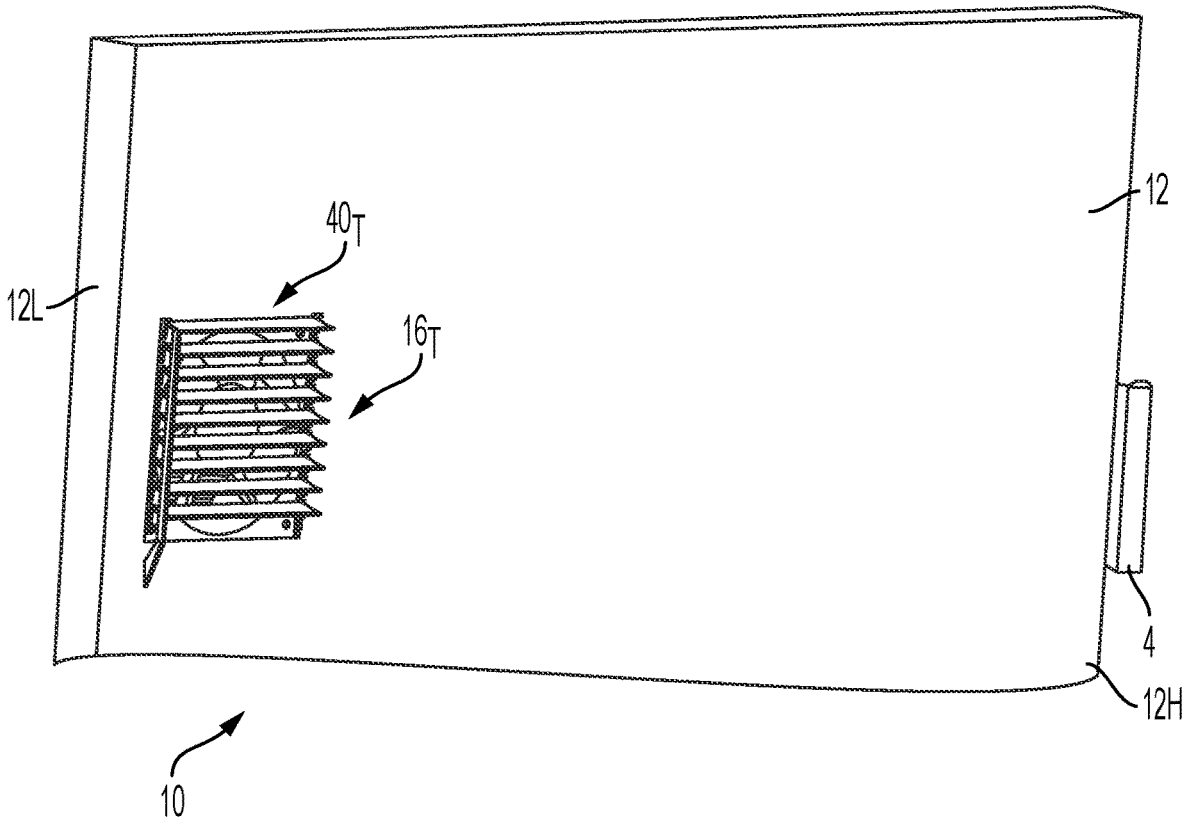
FIG. 7A is a partial interior view of the door according to the first exemplary embodiment showing a top end of the door.

The door 10 further comprises two fan assemblies: an upper fan assembly $\mathbf{40}_T$ mounted to the top end 15T of the door slab 12 and a lower fan assembly $\mathbf{40}_B$ mounted to the bottom end 15B of the door slab 12, as best shown in FIG. 4. Fan assemblies $\mathbf{40}_T$ $\mathbf{40}_B$ generate air flow sufficient to move door slab 12 on its hinges 4. The upper and lower fan assemblies $\mathbf{40}_T$ and $\mathbf{40}_B$, respectively, are preferably structurally identical. In the interest of simplicity, the following discussion will sometimes use a reference numeral 40 without a subscript numeral to designate an entire group of the upper and lower fan assemblies. For example, the reference numeral 40 will be sometimes used when generically referring to the upper and lower fan assemblies $\mathbf{40}_T$ and $\mathbf{40}_B$. Each of the fan assemblies $\mathbf{40}_T$ and $\mathbf{40}_B$ includes an electric reversible fan 42 driven by an electric motor 44, moveable louvers 46, and an actuator assembly 48 provided for moving the louvers 46 between an open position shown in FIG. 7, and a closed position shown in FIG. 8.

The door slab 12 includes an upper vent (or opening) $\mathbf{16}_T$ formed in the top end 15T of the door slab 12, and a lower vent (or opening) $\mathbf{16}_B$ formed in the lower end 15T of the door slab 12, as best shown in FIG. 4. The upper and lower vents $\mathbf{16}_T$ and $\mathbf{16}_B$, respectively, are preferably structurally identical. In the interest of simplicity, the following discussion will sometimes use a reference numeral 16 without a subscript numeral to designate an entire group of the upper and lower fan assemblies. For example, the reference numeral 16 will be sometimes used when generically referring to the upper and lower vents $\mathbf{16}_T$ and $\mathbf{16}_B$.

According to the first exemplary embodiment, the movable louvers 46 of the fan assembly 40 automatically open and close by the actuator assembly 48 in response to the operation of the fan 42. The electric motor 44 of the reversible fan 42 is electrically connected to the electronic control module 24 through a power cable (or wires) 28. The reversible fan 42 provide moving flow of air through a vent (or opening) 16 formed through the door slab 12 and through an air flow path in the door slab 12. The moveable louvers 46 of the fan assembly 40 are mounted on a single side (i.e., on the exterior door facing $\mathbf{13}_1$ the interior door facing $\mathbf{13}_2$) of the door slab 12 only, or on both the exterior and interior door facings $\mathbf{13}_1$ and $\mathbf{13}_2$ of the door slab 12.

Figure 7B:
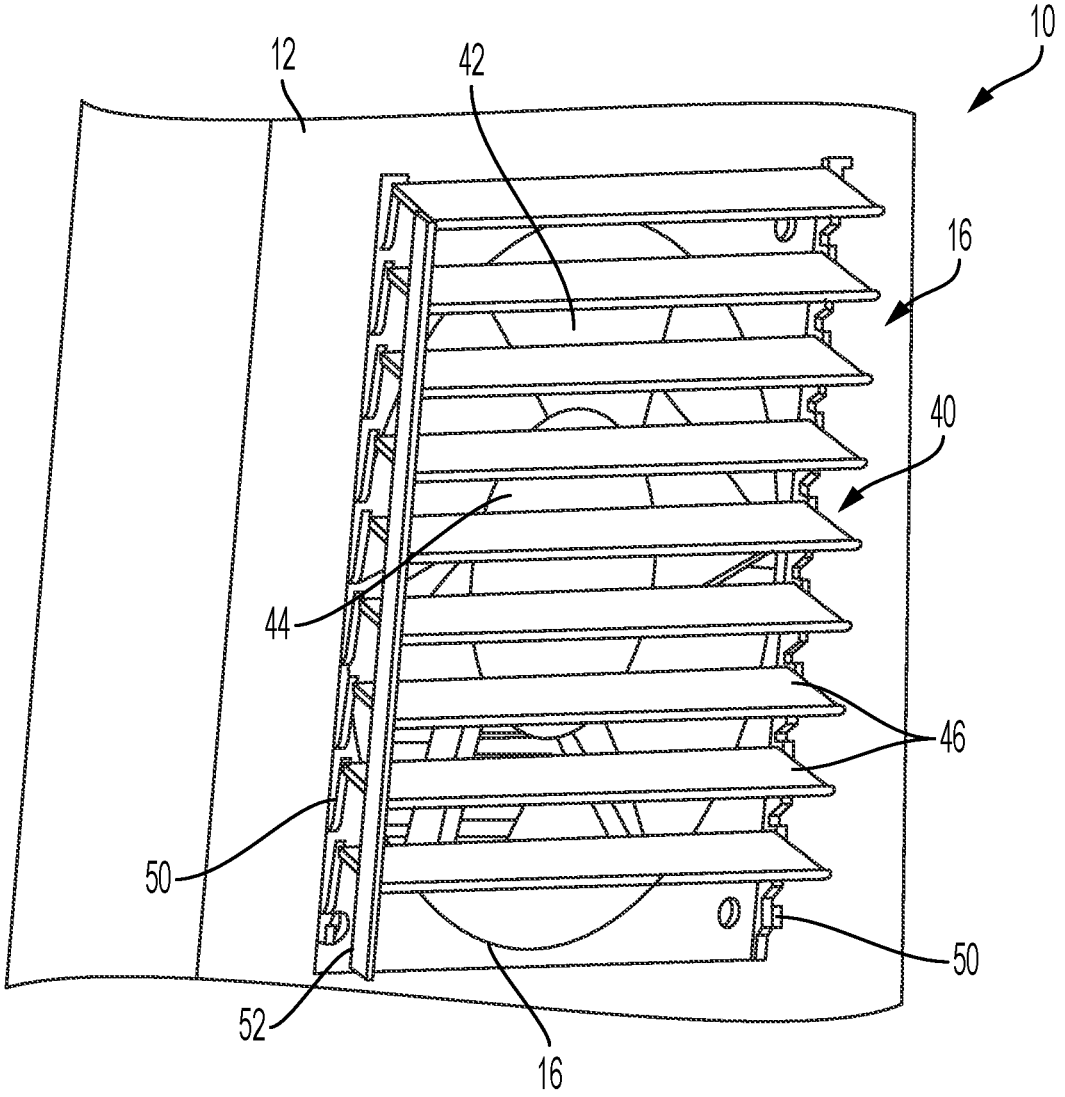
FIG. 7B is an enlarged partial interior view of the door according to the first exemplary embodiment showing a fan assembly in an open position.
Figure 8:
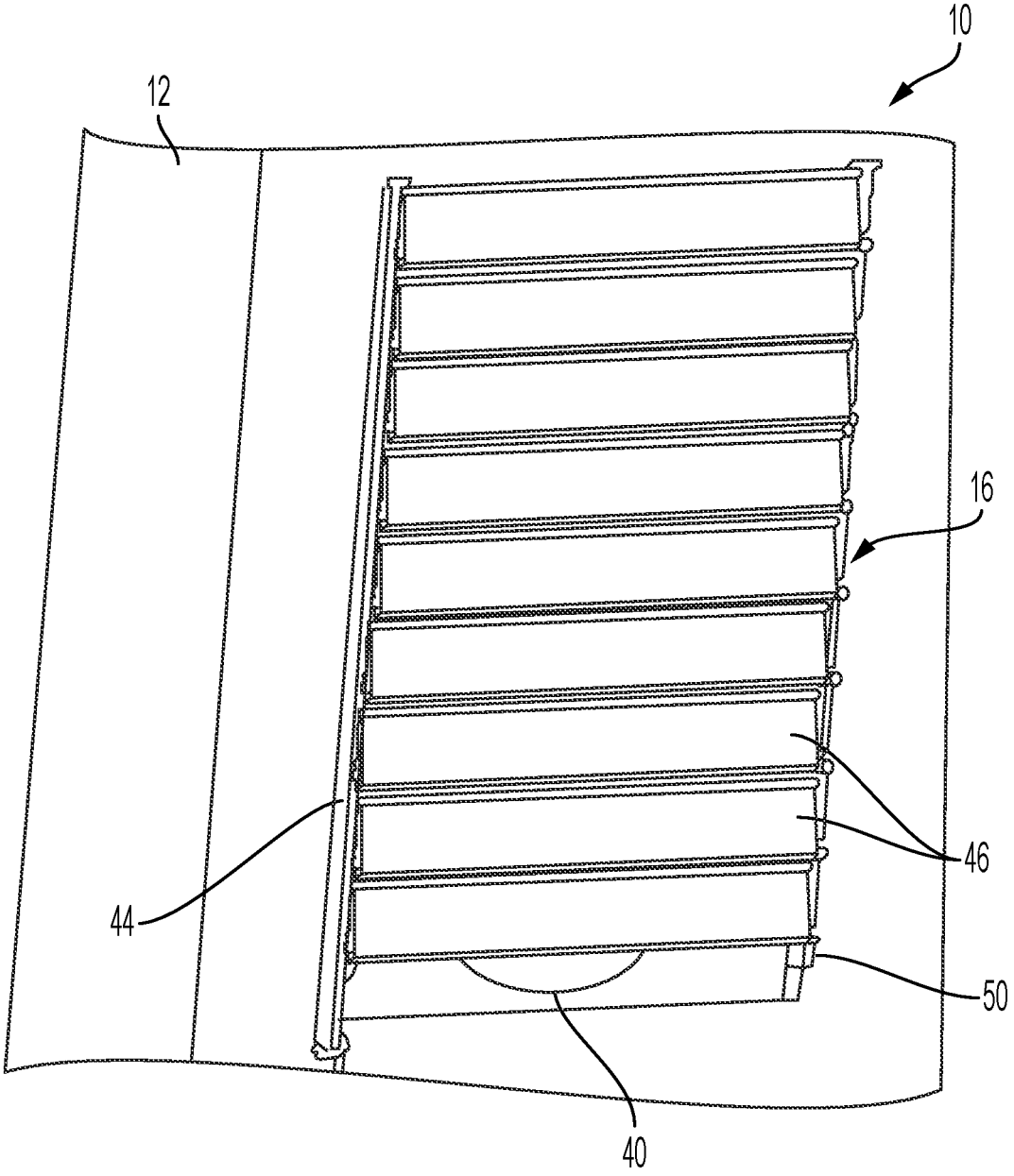
FIG. 8 is an enlarged partial interior view of the door according to the first exemplary embodiment showing the fan assembly in a closed position.
Figure 9:
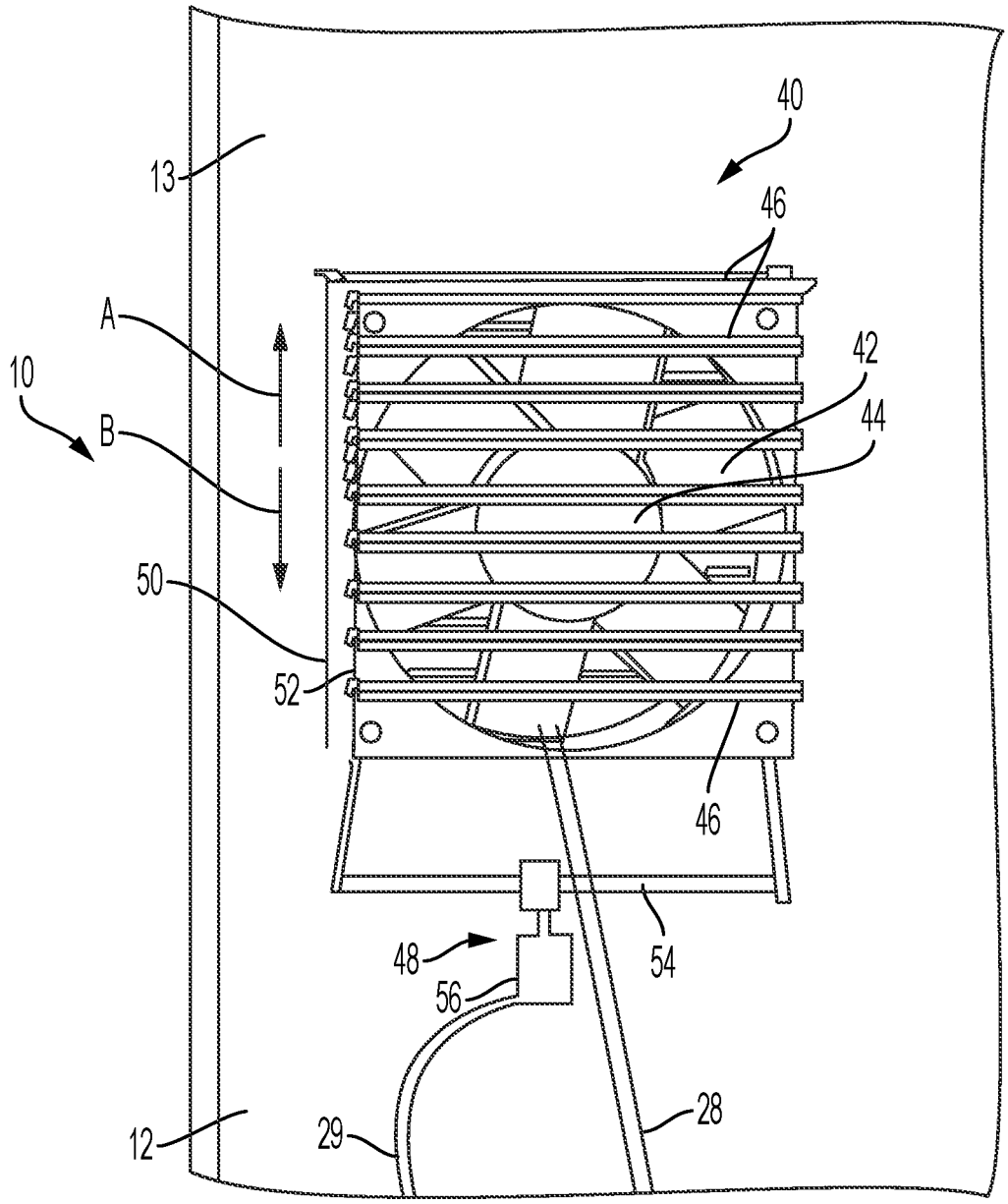
FIG. 9 is an enlarged partial interior view of the door according to the first exemplary embodiment showing the fan assembly with an actuator assembly.

Further according to the first exemplary embodiment, the actuator assembly 48 includes a frame member 50 secured on the exterior or interior sides $\mathbf{13}_1$ or $\mathbf{13}_2$ of the door slab 12. Proximal ends of the moveable louvers 46 are pivotally mounted to the frame member 50, a connecting rod 52 interconnects distal ends of the moveable louvers 46. An actuator motor 56, and a control arm 54 connect the connecting rod 52 with the actuator motor 56. The actuator motor 56 is in the form of an electric actuator, such as a solenoid or an electric motor (e.g., a linear electric motor), electrically connected to the electronic control module 24 through a power cable (or wires) 29. In operation, the actuator motor 56 moves the connecting rod 52 through the control arm 54 to open or close the vent 16 with the louvers 46 when actuated by the electronic control module 24. Specifically, the movement of the connecting rod 52 in the direction A opens the louvers 46 (as best shown in FIGS. 7B and 9), while the movement of the connecting rod 52 in the direction B closes the louvers 46 (as best shown in FIGS. 8 and 9).

As illustrated in FIGS. 1-4, the upper and lower fan assemblies $\mathbf{40}_T$ and $\mathbf{40}_B$ are disposed adjacent to (i.e., at or near) the latch side 12L of the door slab 12. The automated and ventilated door 10 the upper and lower fan assemblies $\mathbf{40}_T$ and $\mathbf{40}_B$ are disposed closer to the latch side 12L of the door slab 12 than to the hinge side 12H of the door slab 12.

Opening and closing force requirements applied at/near a hinge side of the door are high, although force applied at a knob side of the door is low and capable of being provided by a fan. Tests indicate that force at a knob side of a door is as low as 2 lb of force to move the door, i.e., an amount of force that can be generated with a fan.

Accordingly, the upper and lower fan assemblies $\mathbf{40}_T$ and $\mathbf{40}_B$ of the present invention are employed to open and/or close the door 10. The door 10 may be driven by the air flow through the door 10 generated by the reversible fans 42 of the upper and lower fan assemblies $\mathbf{40}_T$ and $\mathbf{40}_B$. In order to open the door 10 (i.e., a door opening operation), the electronic control module 24 opens the louvers 46 and actuates the electric motors 44 of the reversible fans 42 of both the upper and lower fan assemblies $\mathbf{40}_T$ and $\mathbf{40}_B$, so that the reversible fans 42 of both the upper and lower fan assemblies $\mathbf{40}_T$ and $\mathbf{40}_B$ provide an outward air flow through the vents 16 of the door slab 12 in the direction from the room of the house or apartment toward the common area of the house or apartment, as shown in the exemplary configuration of Table 1. At start of the door opening operation the door 10 is open at an angle <10° (i.e., the door 10 is mostly closed), as shown in Table 1. The door 10 is fully open at the end of the door opening operation, as shown in Table 1. The force to open the hollow core door 10 generated by the upper and lower fan assemblies $\mathbf{40}_T$ and $\mathbf{40}_B$ is sufficient to move the door slab 12 toward an open position as the upper and lower fan assemblies $\mathbf{40}_T$ and $\mathbf{40}_B$ are disposed adjacent to the latch side 12L of the door slab 12. During the door opening operation, the latch bolt $\mathbf{19}_2$ of the power door latch 18 is retracted by a command from the electronic control module 24.

TABLE 1

| Operation | Door position at start | Door position at end | Upper Fan | Lower Fan | Latch Status | |
|---|---|---|---|---|---|---|
| Door opening | <10° | Fully open (ending angle dependent on construction) | Outward | Outward | Retract | |
| Door closing | Any | Closed | Inward | Inward | Retract, release before fans stop | |
| Room cooling | <45° | <45° | Outward | Inward | Any | |
| Room warming | <45° | <45° | Inward | Outward | Any | |
| Passive vent | <10° | <10° | Off | Off | Any | Louvers open, fans off |

In order to close the door 10, (i.e., a door closing operation), the electronic control module 24 opens the louvers 46 and actuates the electric motors 44 of the reversible fans 42 of both the upper and lower fan assemblies $\mathbf{40}_T$ and $\mathbf{40}_B$, so that the reversible fans 42 of both the upper and lower fan assemblies $\mathbf{40}_T$ and $\mathbf{40}_B$ provide an inward air flow through the door slab 12 in the direction from the common area of the house or apartment toward the room of the house or apartment, as shown in Table 1. At the start of the door closing operation the door 10 may be in any open position. The door 10 is fully closed at the end of the door closing operation. The force to close the hollow core door 10 generated by the upper and lower fan assemblies $\mathbf{40}_T$ and $\mathbf{40}_B$ is sufficient to move the vents 16 of the door slab 12 and overcome a door latch spring of the spring-loaded latch bolt $\mathbf{19}_2$, as the upper and lower fan assemblies $\mathbf{40}_T$ and $\mathbf{40}_B$ are disposed adjacent to the latch side 12L of the door slab 12. During the door closing operation, the latch bolt $\mathbf{19}_2$ of the power door latch 18 is retracted by a command from the electronic control module 24 and released before the reversible fans 42 stopped by the electronic control module 24, as shown in Table 1.

Figure 10:
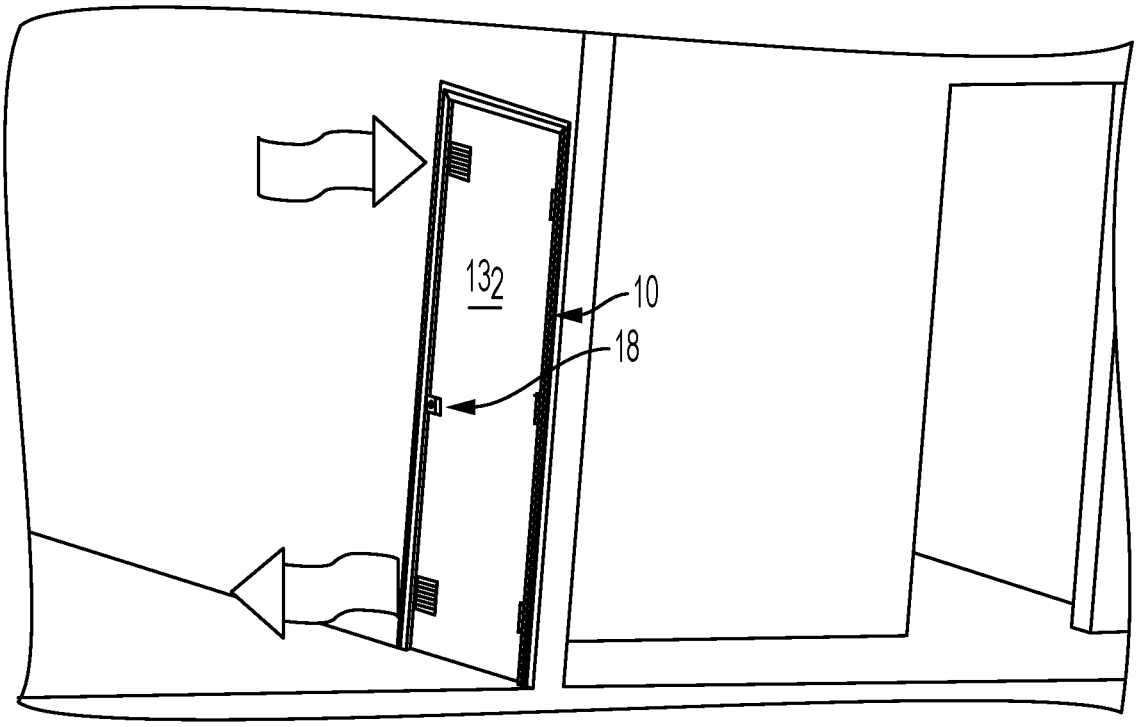
FIG. 10 is the door according to the first exemplary embodiment during a room cooling operation.

The air flow through the door 10 generated by the reversible fans 42 of the upper and lower fan assemblies $\mathbf{40}_T$ and $\mathbf{40}_B$ may also be used to supplement and enhance performance of a HVAC system of the house or apartment. During a room cooling operation, the electronic control module 24 opens the louvers 46 and actuates the electric motor 44 of the reversible fan 42 of the upper fan assembly $\mathbf{40}_T$ so that the reversible fan 42 provides the outward air flow through the upper vent $\mathbf{16}_T$ of the door slab 12 (i.e., warmer air near the ceiling) in the direction from the room of the house or apartment toward the common area of the house or apartment. Consequently, the reversible fan 42 of the lower fan assembly fan $\mathbf{40}_B$ provides an inward air flow through the lower vent $\mathbf{16}_B$ of the door slab 12 (i.e., cooler air near the floor), as shown in Table 1 and FIG. 10. During the room cooling operation, the door 10 has to be open at an angle <45°. If the door is open at an angle >45°, the door is considered "mostly opened". If the door 10 is "mostly opened", the upper and lower vents $\mathbf{16}_T$ and $\mathbf{16}_B$ will not work since the upper and lower fan assemblies $\mathbf{40}_T$ and $\mathbf{40}_B$ face into the room so little or no air exchange occurs with the hallway/outside air.

Figure 11:
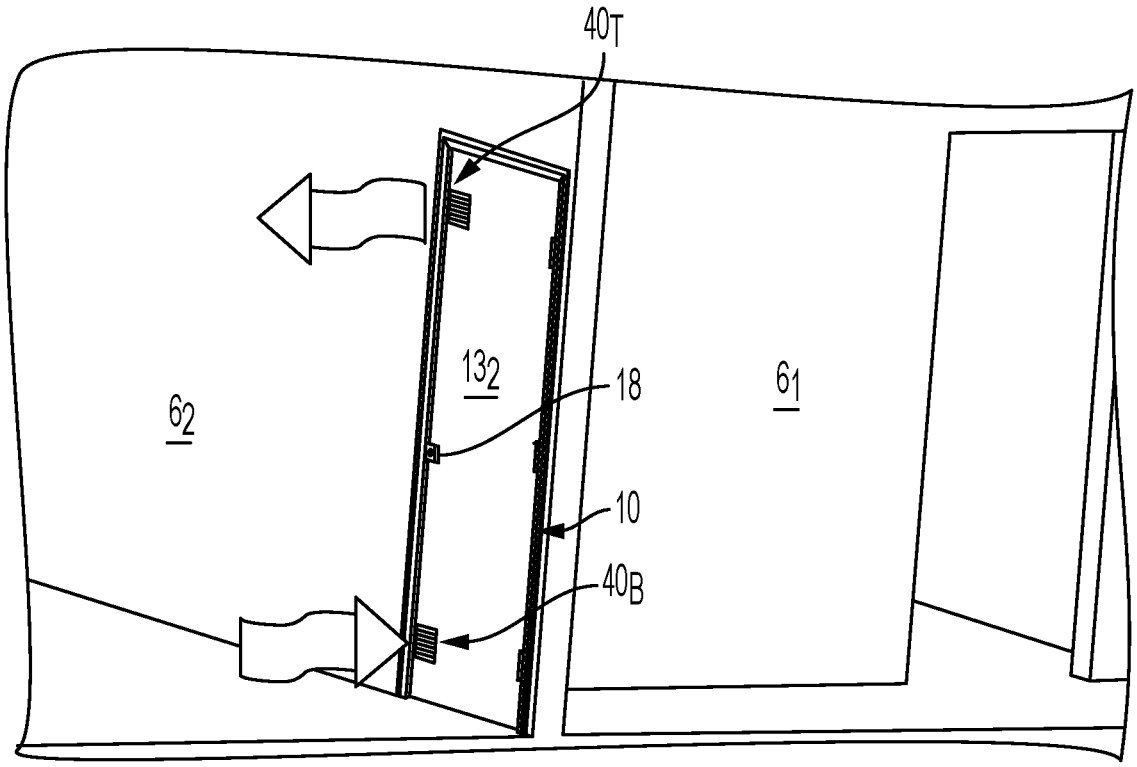
FIG. 11 is the door according to the first exemplary embodiment during a room warming operation.
Figure 12:
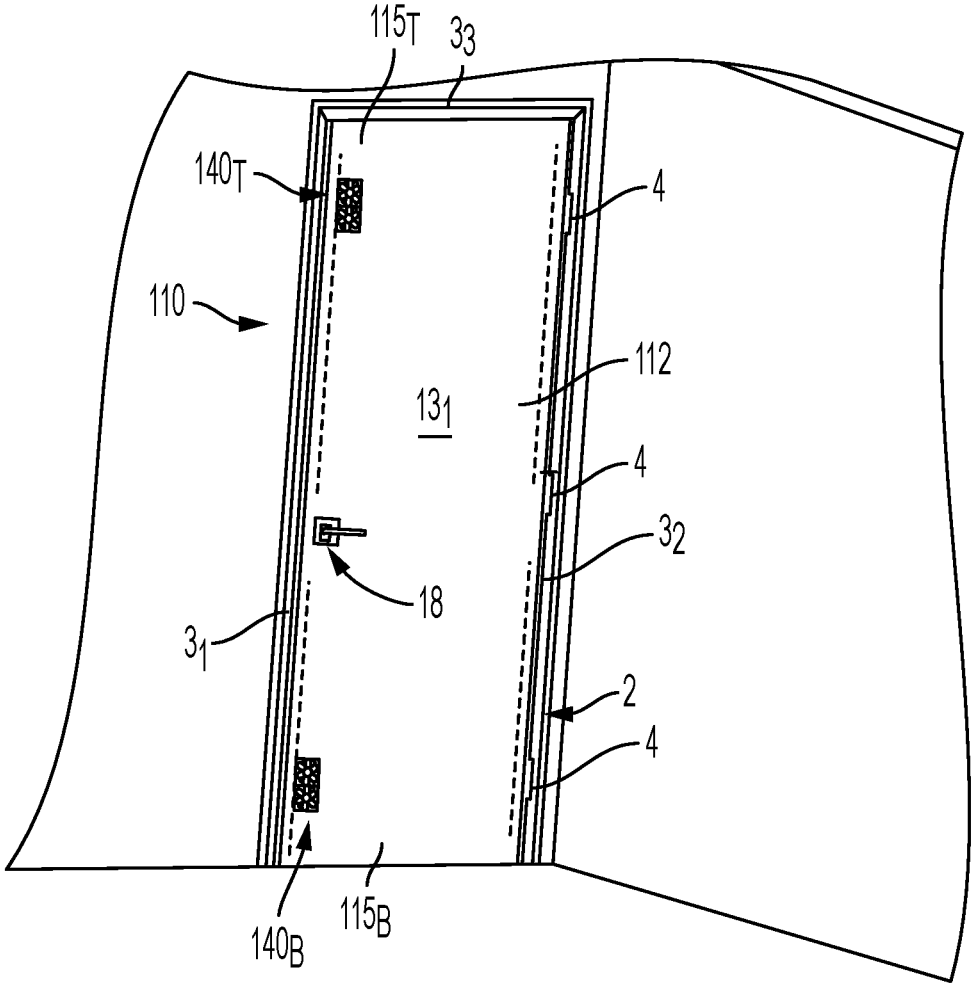
FIG. 12 is a perspective view showing the automated and ventilated door according to a second exemplary embodiment.
Figure 13:
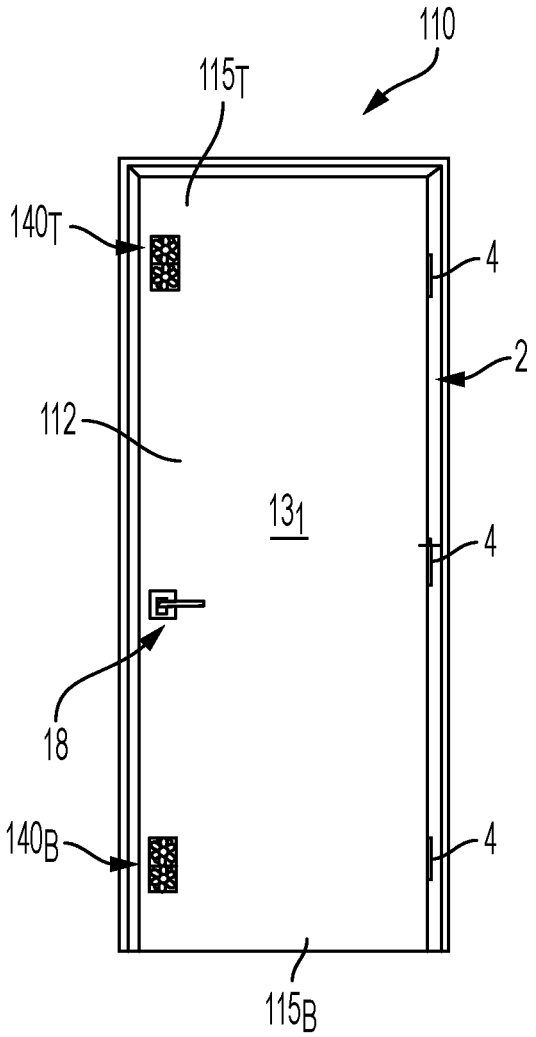
FIG. 13 is an exterior view of the automated and ventilated door according to the second exemplary embodiment mounted to a door frame.

During a room warming operation, the electronic control module 24 opens the louvers 46 and actuates the electric motor 44 of the reversible fan 42 of the upper fan assembly $\mathbf{40}_T$ so that the reversible fan 42 provides an inward air flow through the upper vent $\mathbf{16}_T$ of the door slab 12 (i.e., warmer air near the ceiling). As a consequence, the reversible fan 42 of the lower fan assembly fan $\mathbf{40}_B$ provides an outward air flow through the lower vent $\mathbf{16}_B$ of the door slab 12 (i.e., cooler air near the floor), as shown in Table 1 and FIG. 11. During the room worming operation, the door 10 has to be open at an angle <45°. As noted above, if the door 10 is "mostly opened" (i.e., open at an angle >45°), the upper and lower vents $\mathbf{16}_T$ and $\mathbf{16}_B$ will not work since the upper and lower fan assemblies $\mathbf{40}_T$ and $\mathbf{40}_B$ face into the room so little or no air exchange occurs with the hallway/outside air.

Moreover, when the fans 42 of both the upper and lower fan assemblies $\mathbf{40}_T$ and $\mathbf{40}_B$ are off and the louvers 46 are open, the HVAC system of the house or apartment is in a passive vent operation. During the passive vent operation, the door 10 has to be open at an angle <10° (i.e., the door 10 is mostly closed), as shown in Table 1.

The upper and lower fan assemblies $\mathbf{40}_T$ and $\mathbf{40}_B$ are configured to move the door slab 12 toward the open or closed position are preferably integrated with the HVAC system to optimize interior temperature and control the door open/close position. The air movement generated by the upper and lower fan assemblies $\mathbf{40}_T$ and $\mathbf{40}_B$ may be used to supplement and enhance performance of the HVAC system of the house or apartment, resulting in lower operation costs for the homeowner due to more efficient operation of the HVAC system. The door 10 of the first exemplary embodiment preferably uses two reversible fans 42 with the louvers 46 to both move and position a door depending on how they are powered. Those same fans 42 can be used for the HVAC function, especially when the fans 42 run counter to each other, because running fans of the upper and lower fan assemblies $\mathbf{40}_T$ and $\mathbf{40}_B$ at different heights forwards or backwards creates cooling or warming based on cooler air near the floor and warmer air near the ceiling.

An automated and ventilated door 110 according to a second exemplary embodiment is illustrated in FIGS. 12-17. The door 110 of FIGS. 12-17 corresponds substantially to the automated and ventilated door 10 of the first exemplary embodiment illustrate in FIGS. 1-11, and portions of the door 110, which differ, will therefore be explained in detail below.

The automated and ventilated door 110 of the second exemplary embodiment comprises two fan assemblies: an upper fan assembly $\mathbf{140}_T$ mounted to a top end 115T of a door slab 112 and a lower fan assembly $\mathbf{140}_B$ mounted to a bottom end 115B of the door slab 112. The fan assemblies $\mathbf{140}_T$ and $\mathbf{140}_B$ generate air flow sufficient top move door 110 on its hinges. The upper and lower fan assemblies $\mathbf{140}_T$ and $\mathbf{140}_B$, respectively, are preferably structurally identical. In the interest of simplicity, the following discussion will sometimes use a reference numeral 140 without a subscript numeral to designate an entire group of the upper and lower fan assemblies. For example, the reference numeral 140 will be sometimes used when generically referring to the upper and lower fan assemblies $\mathbf{140}_T$ and $\mathbf{140}_B$.

Figure 15:
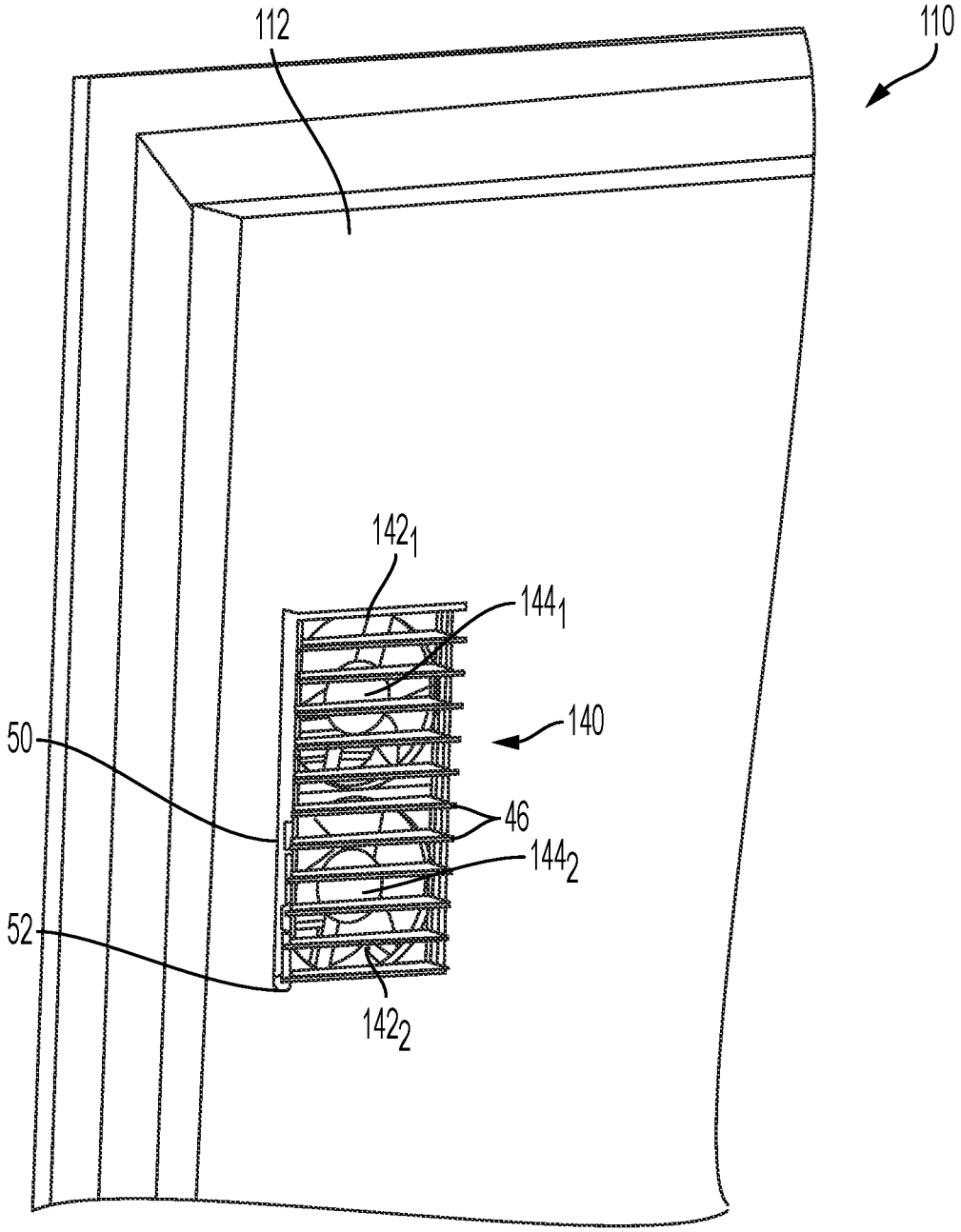
FIG. 15 is a partial interior view of the door according to the second exemplary embodiment showing a top end of the door with a fan assembly.
Figure 16:
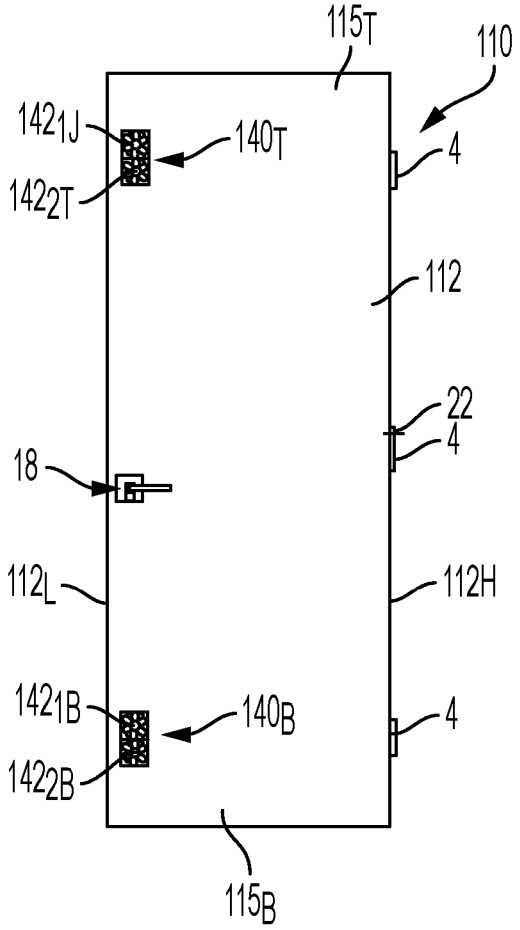
FIG. 16 is an exterior view of the automated and ventilated door according to the second exemplary embodiment.
Figure 17:
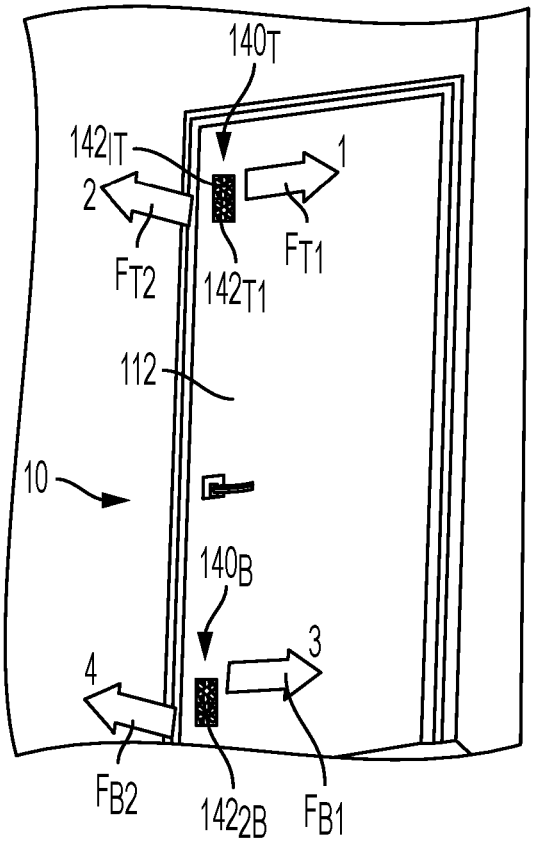
FIG. 17 shows operation of upper and lower fan assemblies of the automated and ventilated door according to the second exemplary embodiment.

Each of the fan assemblies $\mathbf{140}_T$ and $\mathbf{140}_B$ includes two electric unidirectional fans $\mathbf{142}_1$ and $\mathbf{142}_2$ that each driven by an electric motor $\mathbf{144}_1$ and $\mathbf{144}_2$, respectively, in opposite directions, as best shown in FIGS. 15 and 17. Specifically, the fan assembly $\mathbf{140}_T$ includes two electric unidirectional fans $\mathbf{142}_{1T}$ and $\mathbf{142}_{2T}$, while the assembly $\mathbf{140}_B$ includes two electric unidirectional fans $\mathbf{142}_{1B}$ and $\mathbf{142}_{2B}$, as best shown in FIGS. 16 and 17. The unidirectional fans $\mathbf{142}_{1T}$ and $\mathbf{142}_{1B}$ of the upper and lower fan assemblies $\mathbf{140}_T$ and $\mathbf{140}_B$, respectively, generate an inward air flow $F_{T1}$ and $F_{B1}$ (i.e., into the room of the house or apartment), while the unidirectional fans $\mathbf{142}_{2T}$ and $\mathbf{142}_{2B}$ of the upper and lower fan assemblies $\mathbf{140}_T$ and $\mathbf{140}_B$, respectively, generate an outward air flow $F_{T2}$ and $F_{B2}$ (i.e., away from the room of the house or apartment), as best shown in FIG. 17.

Figure 14:
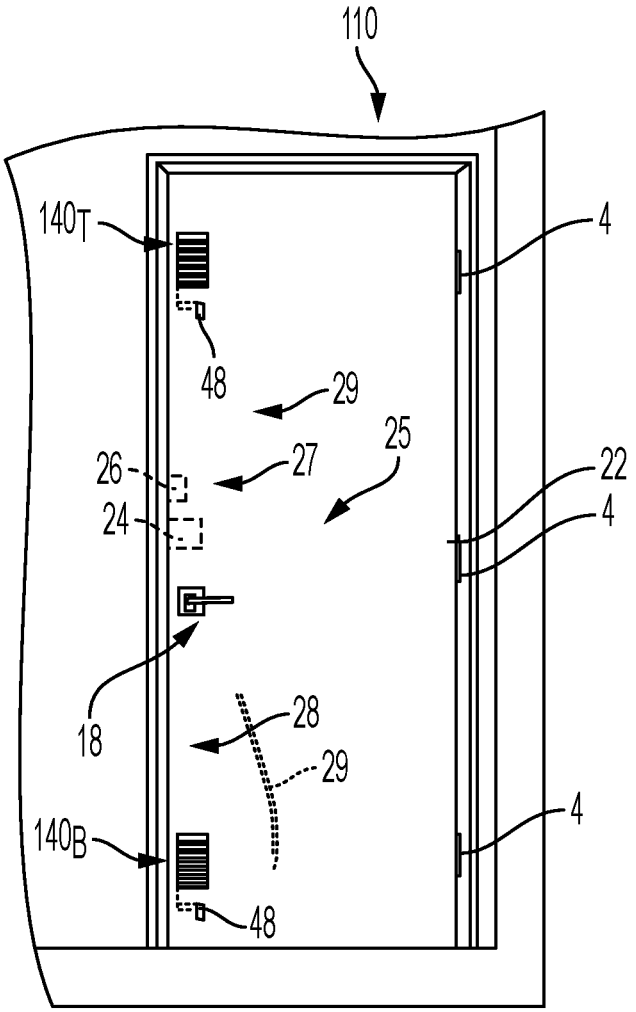
FIG. 14 shows the door of FIG. 12 with portions exposed.

Each of the fan assemblies $\mathbf{140}_T$ and $\mathbf{140}_B$ further includes moveable louvers 46, and an actuator assembly 48 provided for moving the louvers 46 between an open position and a closed position, as best shown in FIGS. 14 and 15. The moveable louvers 46 mounted on the exterior side of the door 110 may be replaced with a static grate or mesh to simplify design and lower cost of the door 110, while the louvers 46 mounted on the interior side of the door 110 are moveable (i.e., active) louvres.

As illustrated in FIGS. 12-17, the upper and lower fan assemblies $\mathbf{140}_T$ and $\mathbf{140}_B$ are disposed adjacent to (i.e., at or near) the latch side 112L of the door slab 112. The automated and ventilated door 110 and its the upper and lower fan assemblies $\mathbf{140}_T$ and $\mathbf{140}_B$ are disposed closer to the latch side 112L of the door slab 112 than to the hinge side 112H of the door slab 112.

The upper and lower fan assemblies $\mathbf{140}_T$ and $\mathbf{140}_B$ of the present invention are employed to open and/or close the door 110. The door 110 may be driven by the air flow through the door 110 generated by the unidirectional fans $\mathbf{142}_{1T}$, $\mathbf{142}_{2T}$, $\mathbf{142}_{1B}$ and $\mathbf{142}_{2B}$ of the upper and lower fan assemblies $\mathbf{140}_T$ and $\mathbf{140}_B$. In order to open the door 110 (i.e., a door opening operation), the electronic control module 24 opens the louvers 46 and actuates the unidirectional fans $\mathbf{142}_{2T}$ and $\mathbf{142}_{2B}$ of both the upper and lower fan assemblies $\mathbf{140}_T$ and $\mathbf{140}_B$. As a consequence, the unidirectional fans $\mathbf{142}_{2T}$ and $\mathbf{142}_{2B}$ of both the upper and lower fan assemblies $\mathbf{140}_T$ and $\mathbf{140}_B$ provide an outward air flow $F_{T2}$ and $F_{B2}$ through the door slab 112 in a direction from the room of the house or apartment toward the common area of the house or apartment, as shown in Table 2. The unidirectional fans $\mathbf{142}_{1T}$ and $\mathbf{142}_{1B}$ are deactivated by the electronic control module 24 during the door opening operation. At start of the door opening operation the door 110 has to be open at an angle of about ≤10°, as shown in Table 2. The door 110 is fully open at the end of the door opening operation, as shown in Table 2. The force to open the hollow core door 110 generated by the upper and lower fan assemblies $\mathbf{140}_T$ and $\mathbf{140}_B$ is sufficient to move the door slab 112 toward an open position as the upper and lower fan assemblies $\mathbf{140}_T$ and $\mathbf{140}_B$ are disposed adjacent to the latch side 112L of the door slab 112. During the door opening operation, the latch bolt $\mathbf{19}_2$ of the power door latch 18 is retracted by a command from the electronic control module 24.

In order to close the door 110, (i.e., a door closing operation), the electronic control module 24 opens the louvers 46 and actuates the unidirectional fans $\mathbf{142}_{1T}$ and $\mathbf{142}_{1B}$ of both the upper and lower fan assemblies $\mathbf{140}_T$ and $\mathbf{140}_B$. As a consequence, the unidirectional fans $\mathbf{142}_{1T}$ and $\mathbf{142}_{1B}$ provide an inward air flow $F_{T1}$ and $F_{B1}$ through the door slab 12 in a direction from the common area of the house or apartment toward the room of the house or apartment, as shown in Table 2. The unidirectional fans $\mathbf{142}_{2T}$ and $\mathbf{142}_{2B}$ are deactivated by the electronic control module 24 during the door closing operation. At the start of the door closing operation the door 110 may be in any open position. The door 110 is fully closed at the end of the door closing operation. The force to close the hollow core door 110 generated by the upper and lower fan assemblies $\mathbf{140}_T$ and $\mathbf{140}_B$ is sufficient to move the door slab 12 toward a closed position and overcome a door latch spring of the spring-loaded latch bolt $\mathbf{19}_2$ as the upper and lower fan assemblies $\mathbf{140}_T$ and $\mathbf{140}_B$ are disposed adjacent to the latch side 112L of the door slab 112. During the door closing operation, the latch bolt $\mathbf{19}_2$ of the power door latch 18 is retracted by a command from the electronic control module 24 and released before the unidirectional fans $\mathbf{142}_{1T}$ and $\mathbf{142}_{1B}$ stopped by the electronic control module 24, as shown in Table 2.

The air flow through the door 110 generated by the unidirectional fans $\mathbf{142}_{1T}$, $\mathbf{142}_{2T}$, $\mathbf{142}_{1B}$ and $\mathbf{142}_{2B}$ of the upper and lower fan assemblies $\mathbf{140}_T$ and $\mathbf{140}_B$ may be used to supplement and enhance performance of a HVAC system of the house or apartment. Specifically, during a room cooling operation, the electronic control module 24 opens the louvers 46 and actuates the electric motor $\mathbf{144}_{2T}$ of the unidirectional fan $\mathbf{142}_{2T}$ of the upper fan assembly $\mathbf{140}_T$ and the electric motor $\mathbf{144}_{1B}$ of the unidirectional fan $\mathbf{142}_{1B}$ of the lower fan assembly $\mathbf{140}_B$ so that the unidirectional fan $\mathbf{142}_{2T}$ provides the outward air flow through the upper vent $\mathbf{16}_T$ of the door slab 112 in the direction from the room of the house or apartment toward the common area of the house or apartment, while the unidirectional fan $\mathbf{142}_{1B}$ of the lower fan assembly fan $\mathbf{140}_B$ provides the inward air flow through the lower vent $\mathbf{16}_B$ of the door slab 112, as shown in Table 2 and FIG. 17. During the room cooling operation, the door 110 has to be open at an angle <45°. The unidirectional fans $\mathbf{142}_{1T}$ and $\mathbf{142}_{2B}$ are deactivated by the electronic control module 24 during the room cooling operation.

TABLE 2

| Operation | Door position at start | Door position at end | Upper Inward Fan | Upper Outward Fan | Lower Inward Fan | Lower Outward Fan | Latch Status | Note |
|---|---|---|---|---|---|---|---|---|
| Door opening | <10° | Fully open (ending angle dependent on construction) | Off | On | Off | On | Retract before activating fan, then release at end of cycle | |
| Door closing | Any | Closed | On | Off | On | Off | Retract, release before fans stop | |
| Room cooling | <45° | <45° | Off | On | On | Off | Any | Warm air out via upper outward fan, cool air in via lower inward fan |
| Room warming | <45° | <45° | On | Off | Off | On | Any | Cool air out via lower outward fan, warm air |
| Passive vent | <10° | <10° | Off | Off | Off | Off | Any | Louvers open, fans off |

During a room warming operation, the electronic control module 24 opens the louvers 46 and actuates the electric motor $\mathbf{144}_{1T}$ of the unidirectional fan $\mathbf{142}_{1T}$ of the upper fan assembly $\mathbf{140}_T$ and the electric motor $\mathbf{144}_{2B}$ of the unidirectional fan $\mathbf{142}_{2B}$ of the lower fan assembly $\mathbf{140}_B$ so that the unidirectional fan $\mathbf{142}_{1T}$ provides the inward air flow through the upper vent $\mathbf{16}_T$ of the door slab 112 in the direction from the room of the house or apartment toward the common area of the house or apartment, while the unidirectional fan $\mathbf{142}_{2B}$ of the lower fan assembly fan $\mathbf{140}_B$ provides the outward air flow through the lower vent $\mathbf{16}_B$ of the door slab 112, as shown in Table 2 and FIG. 17. During the room warming operation, the door 110 has to be open at an angle <45°. The unidirectional fans $\mathbf{142}_{2T}$ and $\mathbf{142}_{1B}$ are deactivated by the electronic control module 24 during the room warming operation.

Moreover, when the unidirectional fans $\mathbf{142}_{1T}$, $\mathbf{142}_{2T}$, $\mathbf{142}_{1B}$ and $\mathbf{142}_{2B}$ of both the upper and lower fan assemblies $\mathbf{140}_T$ and $\mathbf{140}_B$ are off and the louvers 46 are open, the HVAC system of the house or apartment is in a passive vent operation. During the passive vent operation, the door 110 has to be open at an angle <10°, as shown in Table 2.

Thus, the upper and lower fan assemblies $\mathbf{140}_T$ and $\mathbf{140}_B$ configured to move the door slab 112 toward the open or close position thereof are integrated with the HVAC system to optimize interior temperature and control the door open/close position. The air movement generated by the upper and lower fan assemblies $\mathbf{140}_T$ and $\mathbf{140}_B$ may be used to supplement and enhance performance of the HVAC system of the house or apartment.

Therefore, an automated and ventilated door of the present invention provides a simpler mechanism to open and/or close the door as compared to mechanical power door openers that results in lower total cost of functional finished product that can open and close doors with an integrated mechanism, may be app controlled or interfaced to HVAC (through app or controller). The fan driven door positioning mechanism operated by an air pressure results in quieter overall door system with the same functionality.

The foregoing description of the exemplary embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

We claim:

1. An active HVAC door, comprising:

a door;

a door handle;

at least one hinge configured to pivotally couple the door to a frame;

a first fan assembly provided through the door on an upper portion and on the handle side thereof; and a second fan assembly provided through the door on a lower portion and on the handle side thereof, wherein the first and second fan assemblies comprise:

at least one electrically reversible fan driven by an electric motor;

movable louvers; and an actuator configured to move the louvers between open and closed positions based on a signal from an electronic control module.

2. An active HVAC door in accordance with claim 1, wherein the door is pivotally coupled to the frame via plural hinges.

3. An active HVAC door in accordance with claim 1, wherein the fan assemblies are provided in a flow path through a hollow door slab and through interior and exterior door skins.

4. An active HVAC door in accordance with claim 1, further comprising a powered door latch connected to the electronic control module.

5. An active HVAC door in accordance with claim 1, further comprising an angle finder or detector electrically connected to an electronic control module.

6. An active HVAC door in accordance with claim 1, wherein the fan assemblies, actuator and electronic control module are powered by AC or DC power.

7. An active HVAC door in accordance with claim 1, wherein the first and second fan assemblies are configured to be directed by the actuator and the electronic control module to both pass air through the door away from the direction of opening during an opening operation mode.

8. An active HVAC door in accordance with claim 1, wherein the first and second fan assemblies are configured to be directed by the actuator and the electronic control module to both pass air through the door towards the direction of opening during a closing operation mode.

9. An active HVAC door in accordance with claim 1, wherein the first and second fan assemblies are configured to be directed by the actuator and the electronic control module to have the first fan assembly pass air through the door away from the direction of opening and to have the second fan assembly pass air through the door towards the direction of opening during a room cooling operation mode.

10. An active HVAC door in accordance with claim 1, wherein the first and second fan assemblies are configured to be directed by the actuator and the electronic control module to have the second fan assembly pass air through the door away from the direction of opening and to have the first fan assembly pass air through the door towards the direction of opening during a room warming operation mode.

11. A method of opening and closing a door, comprising:

providing a door having a door handle, at least one hinge configured to pivotally couple the door to a frame, a first fan assembly provided through the door on an upper portion and on the handle side thereof and a second fan assembly provided through the door on a lower portion and on the handle side thereof, wherein the first and second fan assemblies comprise at least one electrically reversible fan driven by an electric motor and movable louvers; and using an actuator to move the louvers between open and closed positions based on a signal from an electronic control module.

12. A method of opening and closing a door in accordance with claim 11, wherein the door is pivotally coupled to the frame via plural hinges.

13. A method of opening and closing a door in accordance with claim 11, wherein the fan assemblies are provided in a flow path through a hollow door slab and through interior and exterior door skins.

14. A method of opening and closing a door in accordance with claim 11, further comprising a powered door latch connected to the electronic control module.

15. A method of opening and closing a door in accordance with claim 11, further comprising an angle finder or detector electrically connected to an electronic control module.

16. A method of opening and closing a door in accordance with claim 11, wherein the fan assemblies, actuator and electronic control module are powered by AC or DC power.

17. A method of opening and closing a door in accordance with claim 11, wherein the first and second fan assemblies are configured to be directed by the actuator and the electronic control module to both pass air through the door away from the direction of opening during an opening operation mode.

18. A method of opening and closing a door in accordance with claim 11, wherein the first and second fan assemblies are configured to be directed by the actuator and the electronic control module to both pass air through the door towards the direction of opening during a closing operation mode.

19. A method of opening and closing a door in accordance with claim 11, wherein the first and second fan assemblies are configured to be directed by the actuator and the electronic control module to have the first fan assembly pass air through the door away from the direction of opening and to have the second fan assembly pass air through the door towards the direction of opening during a room cooling operation mode.

20. A method of opening and closing a door in accordance with claim 11, wherein the first and second fan assemblies are configured to be directed by the actuator and the electronic control module to have the second fan assembly pass air through the door away from the direction of opening and to have the first fan assembly pass air through the door towards the direction of opening during a room warming operation mode as shown and described herein.

* * * * *